United States Patent [19]

Axelrod et al.

[11] Patent Number: 4,834,776

[45] Date of Patent: May 30, 1989

[54] LOW TEMPERATURE FLUIDITY IMPROVER

[75] Inventors: Joan C. Axelrod, Media, Pa.; Sheldon Chibnik, Cherry Hill, N.J.

[73] Assignee: Mobil Oil Corporation, New York, N.Y.

[21] Appl. No.: 129,634

[22] Filed: Dec. 7, 1987

[51] Int. Cl.[4] ..... C10L 1/22

[52] U.S. Cl. ..... 44/63; 44/71; 44/72; 548/545; 548/547

[58] Field of Search ..... 44/63, 71, 72; 548/545, 548/547

[56] References Cited

U.S. PATENT DOCUMENTS

| | | | |
|---|---|---|---|
| 2,662,898 | 12/1953 | Ramsey et al. | 548/547 |
| 3,367,943 | 2/1968 | Miller et al. | 44/71 |
| 3,373,111 | 3/1968 | Le Suer et al. | 44/58 |
| 3,962,104 | 6/1976 | Swietlik | 252/34 |
| 4,098,585 | 7/1978 | Vartanian et al. | 44/63 |
| 4,108,613 | 8/1978 | Frost, Jr. | 44/72 |
| 4,631,070 | 12/1986 | Plavac | 44/63 |

*Primary Examiner*—William R. Dixon, Jr.
*Assistant Examiner*—Jerry D. Johnson
*Attorney, Agent, or Firm*—Alexander J. McKillop; Charles J. Speciale; Howard M. Flournoy

[57] ABSTRACT

The incorporation of minor amounts of an additive prepared from the reaction products of a long chain oligomeric alkylsuccinic anhydride or the corresponding acid, a mono or polyfunctional epoxide and a long chain secondary amine provide improved cloud point, pour point and filterability for diesel and heating fuels.

22 Claims, No Drawings

LOW TEMPERATURE FLUIDITY IMPROVER

CROSS-REFERENCE

This application is related to Ser. No. 129,636 filed on 12/7/87 and entitled LOW TEMPERATURE FLUIDITY IMPROVER AND COMPOSITIONS THEREOF.

BACKGROUND OF THE INVENTION

This invention relates to fuel compositions having improved low temperature characteristics. More particularly, this invention relates to compositions comprising distillate hydrocarbon fuels having minor amounts sufficient to improve cloud point, pour point and filterability of diesel and heating fuels of an additive prepared from the reaction products of long chain oligomeric alkylsuccinic anhydride or corresponding acid, a long chain mono- or polyfunctional epoxide and a long chain secondary amine.

As is well known to those skilled in the art, diesel fuels and the like present problems at low temperatures because of poor flow characteristics and clogging of fuel filters. Unmodified diesel fuels have especially poor flow characteristics at colder temperatures where wax crystal formation occurs. Consequently, there is a continuing need for more efficient means for solving these low temperature fluidity problems. The materials described herein, when added to such fuels, improve their low temperature filterability and flowability characteristics.

Although many lubricant and fuel additives have been described from various alkylsuccinic anhydrides and their esters, applicants have discovered that effective products for improving low temperature properties of diesel fuels and the like can be made from specific combinations of raw materials within a limited molecular weight range comprising an alkylsuccinic anhydride or long chain carboxylic acid or polyacid, a mono- or polyfunctional epoxide and a long chain secondary amine.

U.S. Pat. No. 4,108,613 teaches the use of a mixture of (1) the reaction product of an epoxidized alpha-olefin with a nitrogen-containing compound selected from ammonia, an amine, a polyamine or a hydroxyamine and (2) an ethylene-olefin copolymer as an additive to depress the pour point of hydrocarbonaceous fuels and oils.

U.S. Pat. No. 3,962,104 discloses lubricating oil compositions containing minor amounts of quaternary ammonium salts useful as oil improving additives wherein the quaternary ammonium salts utilize a cation derived from the reaction product of a tertiary amine with an olefin oxide and water. None of these prior art materials, however, use the specific combination of raw materials disclosed herein.

One object of this invention is to provide an additive product which will operate to lower the cloud point and the pour point of hydrocarbon fuels and improve their filterability.

A further object of this invention is to provide a convenient process for preparing these additive products.

SUMMARY OF THE INVENTION

Applicants have now discovered novel fuel additive products useful in improving the low temperature characteristics of distillate fuel compositions, which compositions comprise a major proportion of a liquid hydrocarbon fuel and a minor proportion sufficient to impart improved filterability and flowability characteristics thereto, and to provide a lower pour point and lower cloud point to said composition comprising the reaction product of (1) a substantially linear alkylsuccinic anhydride prepared from a substantially linear oligomerized olefin of the following generalized structure:

$$(RCH{=}CH_2)_n$$

where n is 2–4, and where R is about $C_2$ to $C_{32}$ hydrocarbyl; (2) a long chain, $C_{14+}$ fatty or alphatic secondary amine (3) and a long chain $C_{12+}$ high molecular weight epoxide.

DESCRIPTION OF PREFERRED EMBODIMENT

Applicants have found that to be effective the products for improving low temperature properties of diesel fuels or heating fuels in accordance with their discovery must be made from specific combinations of raw materials within a limited molecular weight range:

(1) The alkylating olefin used to prepare the alkylsuccinic anhydride must be essentially linear.

(2) The olefin must be carefully oligomerized so that for $(RCH{=}CH_2)_n$, n is about 2–4. When n is 1, or 5 or more, the materials have proven ineffective. (Mixtures, however, may contain some material where n is outside the limits).

(3) The amine must be secondary; primary amines are ineffective.

(4) The epoxide should have a MW of at least about 185.

Suitable liquid hydrocarbon fuels or distillates generally have an initial boiling point of about 350° F. and an end point of about 675° F. However, it is understood that the additives in accordance with this invention may be utilized in hydrocarbon fuels outside these specific boiling ranges. Generally speaking, these additive products may be utilized in any unmodified diesel fuel which has poor flow characteristics at winter temperatures and where wax crystal formation occurs.

Suitable alkyl succinic anhydrides are those wherein the alkyl group is an oligomer of long chain alkenes. As noted hereinabove, the chain must contain at least 14 carbon atoms. There is no critical upper limit. However, preferably, the chain should contain from 16 to about 40 carbon atoms. With respect to the olefin described above as being $(RCH{=}CH_2)_n$, the nature of the R substituent is not critical but preferably will contain from about 12 to about 32 and preferably 16 to about 24 carbon atoms.

The epoxides useful herein generally contain from at least from about 12 to about 30 carbon atoms. The epoxides may be substituted with an aromatic or a saturated or unsaturated aliphatic group. Among the preferred epoxides that may be used in the present invention are decene epoxide, tetradecene epoxide and octadecene epoxide and the like. It is emphasized that the above list is non-limiting. Any other suitable epoxides, within the preferred group of epoxides having from about from 12 to about 30 carbon atoms may be advantageously used. The MW of these epoxides will generally range from about 185 to about 500 or more.

Suitable secondary amines generally having the formula R—NH—R where R is about $C_{14}$ to about $C_{30}$ hydrocarbyl includes, but are not limited to the following: dicocoamine, or N-ethyl-oleylamine, N-methyl soya amine, di-tallow amine, and the like are also believed to be suitable.

Normal epoxide/amine reaction temperatures are room temperature or ambient to about 225° C. Normal esterification conditions are used (100°-250° C., azeotropic removal of water, etc.). Any suitable method, however, is acceptable. Oligomerization may be by any convenient method as for example as shown in Example 1, infra.

The additives in accordance with the invention may be used effectively in hydrocarbyl distillate diesel fuels in an amount ranging from about 0.01 wt.% to about 5 wt.% or more based on the total weight of the fuel composition. In certain cases depending, for example, on a particular fuel and/or on weather conditions, up to about 10 wt.% may be used. Other known additives may also be used for their intended purposes without deleterious effect upon the additives of the invention.

The following exemplary material is intended to be merely illustrative of the invention. It is not intended in any way to limit it.

EXAMPLE 1

Preparation of an Oligomer

A commercial mixture of hexadecenes and octadecenes in which the double bond may be placed anywhere in the linear carbon chain (500 g) was mixed with a 2.3 g n-butanol and heated to 52°-57° C. in a dry inert atmosphere. Boron trifluoride (7.3 g) was gradually added over a three hour period, maintaining the temperature in about this range to accelerate the reaction without corrosion of the equipment. The reaction mixture was held at this temperature for a further three hours after the addition was complete. The catalyst was neutralized with 30 cc of concentrated ammonia in 200 cc water, and the product was washed.

EXAMPLE 2

Preparation of Alkylsuccinic Anhydride

The oligomer prepared in Example 1 (155.5 g) was heated to 235° C. and 41.5 g maleic anhydride was added over a two hour period. The mixture was held at that temperature an additional three hours before stripping the excess maleic anhydride at 160° C. under vacuum for three hours.

Preparation of Additives

EXAMPLE 3

A commercial mixture of epoxidized $C_{24-28}$ olefins (16.2 g, 0.04 moles), was heated with a commercial di(hydrogenated tallow) amine (21.3 g, 0.04 moles), with stirring at 125° C. for three hours. A dimerized $C_{16-18}$ alkylsuccinic anhydride (12.8 g, 0.02 moles) prepared in the manner of Example 2 was added, the temperature raised to 175° C. and the reaction mixture held at that temperature for three hours. The final acid value was 2.

EXAMPLE 4

A preparation similar to Example 3 was made substituting an equimolar amount of a commercial $C_{18-20}$ alpha olefin epoxide for the $C_{24-28}$ epoxided olefins.

Comparative Examples

EXAMPLE 5

This Example uses a commercially available reaction product of tallow amine and a low molecular weight epoxide. A commercial reaction product of tallow amine and 2 moles of ethylene oxide, (57.6 g, 0.16 moles) was reacted with dimerized $C_{18-24+}$ alkylsuccinic anhydride at 160° C., using toluene to azeotropically remove the water. When no more water evolved, the reaction was finished at 150° C. for 3 hours under vacuum. This product had no effect on the cloud point of the test Diesel Fuel.

EXAMPLE 6

This Example uses a long chain primary amine instead of the secondary amine of Example 3. Hydrogenated tallow amine (14.2 g, 0.05 moles) and 20.1 g $C_{24-28}$ epoxidized olefins (0.05 moles) were heated at 125° for three hours. The same alkylsuccinic anhydride used in Example 1 (15.9 g, 0.025 moles) was added and the reaction completed as in Example 3. This additive did not materially lower the cloud point.

The additive materials are blended (0.1% by weight) into a typical diesel fuel described below and tested for cloud point, pour-point, filterability by the LTFT procedure described below. Properties of the test diesel fuel are shown in Table 1.

TABLE 1

| Typical Diesel | Distillation | °F. |
|---|---|---|
| Fuel | Initial | 366 |
| | 50° C. | 487 |
| | End | 663 |
| API Gravity | 34.8 | |
| Sulfur | 0.17% | |
| Aniline Point | 130° F. | |

LTFT, Low Temperature Flow Test for Diesel Fuels, a filtration test under consideration by CRC (Coordination Research Council). LTFT Procedure: The test sample (200 ml) is gradually lowered to the desired testing temperature at a controlled cooling rate. After reaching that temperature the sample is removed from its cold box and filtered under vacuum through a 17 micrometer screen. If the entire sample can be filtered in less than 60 seconds it shall be considered as having passed the test. The cloud point and pour point data are obtained by standard ASTM Tests, respectively (D-250 and D-97).

A review of Table 2 highlights the criticality claimed for the individual reactants. Thus the data of Table 2 show the highly successful and improved results obtained when additives in accordance with the invention are incorporated into diesel fuels.

TABLE 2

| Example | Cloud Point | LTFT | Pour Point |
|---|---|---|---|
| Base Fuel | 22 | 18 | 0 |
| 3 | 17 | 14 | −20 |
| 4 | 18 | 14 | −40 |
| 5 | 21 | — | — |
| 6 | 21 | — | — |

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed:

1. A composition comprising a major proportion of a liquid hydrocarbon fuel and a minor proportion of an additive product sufficient to impart improved filterability characteristics thereto and to provide a lower pour point and a lower cloud point for said composition, said additive product comprising the reaction product of (a) a substantially linear alkylsuccinic anhydride or the corresponding acid prepared from a substantially oligomerized olefin of the following generalized structure:

$(RCH{=}CH_2)_n$ where n is from 2 to 4 and where R is from about $C_{12}$ to about $C_{32}$ hydrocarbyl and the corresponding acid or anhydride (b) at least a $C_{12+}$ mono- or polyfunctional epoxide, and (c) at least a $C_{14}$ secondary amine.

2. The composition of claim 1 wherein said epoxide is monofunctional.

3. The composition of claim 1 wherein said epoxide is polyfunctional.

4. The composition of claim 1 wherein the epoxide is a diepoxide.

5. The composition of claim 1 wherein said alkylsuccinic anhydride is prepared from a mixture of hexadecene and octadecene oligomerized olefins and maleic anhydride and where n is 2; the epoxide is a mixture of $C_{24-28}$ epoxidized olefins and the amine is a di(hydrogenated) tallow amine.

6. The composition of claim 5 wherein said alkylsuccinic anhydride is prepared from a mixture of substantially linear $C_{16-18}$ olefins and the epoxide is a monofunctional epoxide.

7. The composition of claim 1 wherein the epoxide is a $C_{18}$–$C_{20}$ alpha olefin epoxide.

8. The composition of claim 5 wherein the epoxide is a polyfunctional epoxide.

9. The composition of claim 1 wherein said fuel is a diesel fuel.

10. The composition of claim 1 wherein said fuel is a heating fuel.

11. The composition of claim 5 wherein said fuel is a diesel fuel.

12. The composition of claim 5 wherein said fuel is a heating fuel.

13. The composition of claim 6 wherein said fuel is a diesel fuel.

14. The composition of claim 6 wherein said fuel is a heating fuel.

15. The composition of claim 7 wherein said fuel is a diesel fuel.

16. The composition of claim 7 wherein said fuel is a heating fuel.

17. An additive product suitable for use in liquid hydrocarbon fuel imparting thereto improved filterability characteristics and providing lower pour points and lower cloud points for said fuels, said additive product comprising the reaction product of (a) a substantially linear alkylsuccinic anhydride having been prepared from a substantially oligomerized olefin of the following generalized structure:

$(RCH{=}CH_2)_n$ where n is 2–4 and where R is from about $C_{12}$ to about $C_{32}$ hydrocarbyl, and the corresponding acid or anhydride (b) a $C_{24}$ to $C_{28}$ mono or polyfunctional epoxide or mixtures thereof and, (c) at least a $C_{14}$ secondary amine.

18. The additive product of claim 17 wherein said alkylsuccinic anhydride is prepared from a mixture of hexadecenes and octadecenes oligomerized olefins and maleic anhydride and where n is 2; the epoxide is a mixture of $C_{24-28}$ epoxidized olefins and the amine is di(hydrogenated) tallow amine.

19. The additive product of claim 17 wherein said alkylsuccinic anhydride is prepared from a mixture of hexadecene and octadecene oligomerized olefins and maleic anhydride and where n is 2; the epoxide is a $C_{18-20}$ alpha olefin epoxide.

20. The additive product of claim 17 wherein said epoxide is a diepoxide.

21. The additive product of claim 17 wherein the fuel is a distillate fuel.

22. The additive product of claim 21 wherein said fuel is a diesel fuel.

* * * * *